US005647774A

United States Patent [19]

Yamamoto

[11] Patent Number: 5,647,774

[45] Date of Patent: Jul. 15, 1997

[54] ELECTRICAL CONNECTOR

[75] Inventor: Masaya Yamamoto, Shizuoka-ken, Japan

[73] Assignee: Yazaki Corporation, Tokyo, Japan

[21] Appl. No.: 521,328

[22] Filed: Aug. 30, 1995

[30] Foreign Application Priority Data

Aug. 31, 1994 [JP] Japan ..... 6-206854

[51] Int. Cl.[6] ..... H01R 13/514

[52] U.S. Cl. ..... 439/752; 439/140

[58] Field of Search ..... 439/752, 140, 439/595

[56] References Cited

U.S. PATENT DOCUMENTS

| | | | |
|---|---|---|---|
| 5,051,100 | 9/1991 | Kato et al. | 439/140 |
| 5,232,373 | 8/1993 | Sawada . | |
| 5,516,308 | 5/1996 | Yamanashi | 439/752 |

FOREIGN PATENT DOCUMENTS 5-36778 5/1993 Japan .

*Primary Examiner*—Neil Abrams
*Assistant Examiner*—Eugene G. Byrd
*Attorney, Agent, or Firm*—Oblon, Spivak, McClelland, Maier & Neustadt, P.C.

[57] ABSTRACT

An electrical connector consisting of a housing, a cover and a retainer is provided. The housing is provided with terminal-accommodating chambers. The cover is attached to the housing so as to slide between a "closed" position and a "opened" position. Moving from its temporary engagement position to its formal engagement position, the retainer engages with the terminal metals to prevent them from slipping out of the terminal-accommodating chambers. When the terminal metals are not inserted into the terminal-accommodating chambers perfectly, the retainer restricts the movement of the cover from the closed position to the opened position, interfering with the terminal metals, so that it allows an operator to detect that the terminal metals are in semi-inserting condition. In order to secure this detection, the cover is provided with a rib and the housing is provided with a dovetail groove which engages with the rib.

3 Claims, 6 Drawing Sheets

ELECTRICAL CONNECTOR

BACKGROUND OF THE INVENTION

The present invention relates to an electrical connector and more particularly, it relates to a connector having a cover which is capable of closing connection portions of respective terminals to be connected with terminal sections of a printed board or the likes.

In the prior art, Japanese Unexamined Utility Model Publication (KoKai) No. 5-36778 discloses a connector which is similar to the above-mentioned connector. This connector, which is provided for connecting respective terminals of wires to terminal sections in a printed board, comprises a housing, a cover and a retainer. The housing is provided with terminal-accommodating chambers into which a plurality of terminal are respectively accommodated. In each terminal-accommodating chamber, a flexible engagement arm is formed to project from an inside wall of the chamber. By respective engagements of the flexible engagement arms with the terminals, it is possible to prevent the terminals from slipping out of the terminal-accommodating chambers. The terminal-accommodating chamber include a part which is opened outwardly and through which a contact portion of the terminal is exposed to an outside to come into contact with the terminal section in the printed board. This opened part of the terminal-accommodating chamber is adapted to be closed by the cover.

The cover, which is shaped to be a plate, is movably supported in guide grooves formed at both sides of the housing. That is, the cover can slide between a "closed" position where the opened part of the chamber is closed and another "opened" position where the opened part of the chamber is opened.

In connecting the terminal sections of the printed board with the contact portions of the terminal, the cover is shifted to the opened position. On the other hand, under condition of connecting the terminal sections of the printed board with the contact portions of the terminal, the cover is moved to the closed position thereby to protect the terminal.

The retainer includes a flexible plate and a plurality of convex portions which are formed on the flexible plate so as to abut on rear ends of the terminals in the terminal-accommodating chamber thereby to prevent the terminals from slipping out. The retainer is mounted on the housing so as to occupy both its temporary engagement position and its formal engagement position. Under condition that the retainer occupies the temporary engagement position, the convex portions of the retainer do not abut on the rear ends of the terminals thereby to restrict the movement of the cover from the above-mentioned closed position to the opened position. On the contrary, in the formal engagement position, the convex portions are brought into contact with the rear ends of the terminals and the front part of the cover thereby to enable the cover to move from the closed position to the opened position.

In this connector, when the terminal is not inserted into the terminal-accommodating chamber sufficiently (the "semi-inserting" condition), it is impossible to move the retainer from the temporary engagement position to the formal engagement position since the convex portions interfere with an upper part of the terminal. Since such a condition makes it impossible to shift the cover to the opened position, it allows an operator to detect the terminal in the semi-inserting condition. Consequently, it excludes a forced connection of the terminal in the semi-inserting condition with the terminal sections of the printed board.

Under condition that the terminal is accommodated in the terminal-accommodating chamber in the semi-inserting condition, however, if forcing the retainer to shift from the temporary engagement position to the formal engagement position by force, there would be raised a problem that the retainer is deformed to move to the formal position because of its flexible structure thereby causing the cover to be shifted from the closed position to the opened position.

That is, when moving the retainer from the temporary engagement position to the formal engagement position and if the terminal metal is accommodated in the terminal-accommodating chamber in the semi-inserting condition, the detecting projection would interfere with an upper part of the terminal metal, it is impossible to move the retainer to the formal engagement position, primarily. However, since the detection plate of the retainer is shaped to be flat in the conventional connector, if depressing the retainer to the formal engagement position, the detection plate can be deformed in an arc, so that it is attached to the formal engagement position.

Thus, since an area where the retainer abuts on the cover is reduced and the cover is easy deflectable for its plate-configuration, it allows the cover to be moved to the opened position. Consequently, the terminal metal would be brought into a condition that enables it to be connected with the terminal section of the board in spite that the terminal metal is in the semi-inserting condition. That is, in the above-mentioned conventional connector, it has been impossible for an operator to find that the inserted terminal metal is now in the semi-inserting condition, securely.

SUMMARY OF THE INVENTION

It is therefore an object of the present invention to provide an electrical connector of which cover cannot be moved from the opened position to the closed position under condition that the terminal metal is not accommodated in the terminal-accommodating chamber perfectly, whereby it is possible for an operator to detect that the terminal is accommodated in the terminal-accommodating chamber in a so-called "semi-inserting" condition, securely.

The object of the invention described above can be accomplished by an electrical connector for connecting a terminal metal having a contact portion to be connected with a terminal section of a board, the connector comprising:

a housing having a terminal-accommodating chamber formed therein for accommodating and engaging the terminal metal in condition of exposing the contact portion, a cover attached to the housing so as to slide between a closed position where the cover closes the contact portion and an opened position where the cover opens the contact portion the when the terminal metal is connected to the terminal section of the board, a retainer which can engage with the terminal metal in the terminal-accommodating chamber by its movement from its temporary engagement position to its formal engagement position thereby to prevent the terminal metal from slipping out of the terminal-accommodating chamber, the retainer also abutting on the terminal metal when it is not inserted into the terminal-accommodating chamber perfectly thereby to obstruct the movement of the cover from the closed position to the opened position, whereby it allows an operator to detect that the terminal metal is not accommodated in the terminal-accommodating chamber perfectly, and preventing means for preventing the deflection of the cover in the closed position.

With the arrangement mentioned above, under condition that the retainer is attached to the housing in the temporary engagement position, the terminal metal is inserted into the terminal accommodating chamber and accommodated therein by the operator. In this state, the contact portion of the terminal metal is closed by the cover. Next, when moving the retainer to the formal engagement position, the detecting projection will be engaged with the terminal metal thereby to prevent the terminal metal from slipping out of the terminal-accommodating chamber. In this state, it allows the cover to be moved from the closed position to opened position where the contact portion is exposed, so that it is possible to the connect the terminal with the terminal section of the board.

Hereat, in even a case that the terminal-accommodating chamber accommodates the terminal metal therein in the semi-inserting condition and when depressing the retainer against the housing, the retainer is deflected to shift from the temporary engagement position to the formal engagement position, so that an area of the retainer abutting on the cover is decreased. However, since a deflection of the cover positioned in the closed position is restricted by the preventing means, the cover abuts on a part of the retainer without being deformed, whereby it is possible to prevent the cover from moving to the opened position.

In the present invention, preferably, the preventing means consists of a dovetail groove arranged on either one of the cover and the housing and a first rib arranged on the other one of the cover and the housing to slidably engage in the dovetail groove.

With the arrangement mentioned above, in even a case that the terminal-accommodating chamber accommodates the terminal metal therein in the semi-inserting condition and when depressing the retainer against the housing, the retainer is deflected to shift from the temporary engagement position to the formal engagement position, so that an area of the retainer abutting on the cover is decreased. However, since a deflection of the cover positioned in the closed position is restricted by an engagement of the first rib into the dovetail groove, the cover abuts on a part of the deflected retainer, so that the movement of the cover to the opened position can be prevented securely. In this case, owing to its configuration of the dovetail groove, it is possible to prevent the cover from being raised from the housing.

More preferably, the retainer is provided with a second rib which slidably engages with the dovetail groove when the cover moves to the opened position.

In this case, if moving the retainer to the formal engagement position to shift the cover positioned in the closed position to the opened position, the second rib is engaged in the dovetail groove arranged in the cover. In case that the terminal metal is in the semi-inserting condition and that it is required to move the retainer from the temporary engagement position to the formal engagement position by force, the retainer would be deformed, so that the second rib cannot be engaged in the dovetail groove even though the cover is to be moved to the opened position. Therefore, in this case, the movement to the opened position can be prevented securely. Further, because of a provision of the second rib to the retainer, the cover can be moved from the closed position to the opened position.

Preferably, the housing has a connection part for exposing the contact portion of the terminal metal, the connection part being provided with the first rib, and support walls for supporting the retainer in both the temporary engagement position and the formal engagement position. Furthermore, preferably, the contact portion of the terminal metal is closed by the cover closing the connecting part of the housing. When the retainer is in the temporary engagement position, the cover is prevented from moving to the opened position. When the retainer is in the formal engagement position, the cover is slid and moved to the opened position, overlapping with the retainer, whereby the connection part is opened.

With such an arrangement that the connector includes, by the cover closing the connection part of the housing, the contact portion of the terminal metal is closed. In such a condition, by the engagement of the first rib into the dovetail groove of the cover, the deformation of the cover can be restricted.

When moving the retainer to the formal engagement position, it enables the cover to be shifted to the opened position. Thus, when moving the cover to the opened position, the second rib engages into the dovetail groove. In this case, even if there is a terminal metal under the semi-inserting condition in the terminal-accommodating chamber, the retainer may be deformed to move from the temporary engagement position to the formal engagement position. In even such a case, however, since the second rib does not engage with the dovetail groove of the cover, the movement of the cover to the opened position can be avoided, abutting on a part of the retainer.

Furthermore, it is preferable that the retainer comprises a pair of sidewalls which engage with the support walls of the housing, a detection plate arranged between the sidewalls and a detecting projection formed on the detection plate corresponding to the terminal-accommodating chamber, and that the second rib is arranged on the detection plate.

Also in this case, even if there is the terminal metal under the semi-inserting condition, the retainer may be deformed to move from the temporary engagement position to the formal engagement position. However, since the second rib arranged on the detection plate does not engage with the dovetail groove of the cover, the movement of the cover to the opened position can be avoided securely.

In the present invention, preferably, the cover is moved from the closed position to the opened position by a connection operation between the terminal section of the board and the terminal metal.

In such a case, corresponding to an connecting operation between the terminal section of the board and the terminal metal, the cover is moved from the closed position to the opened position, so that the connection of the terminal metal with the terminal section of the board can be realized, exposing the contact portion of the terminal metal.

These and other objects and features of the present invention will become more fully apparent from the following description and appended claims taken in conjunction with the accompanying drawings.

DESCRIPTION OF THE PREFERRED EMBODIMENT

One embodiment of the present invention will now be described with reference to the drawings.

Figure 1:
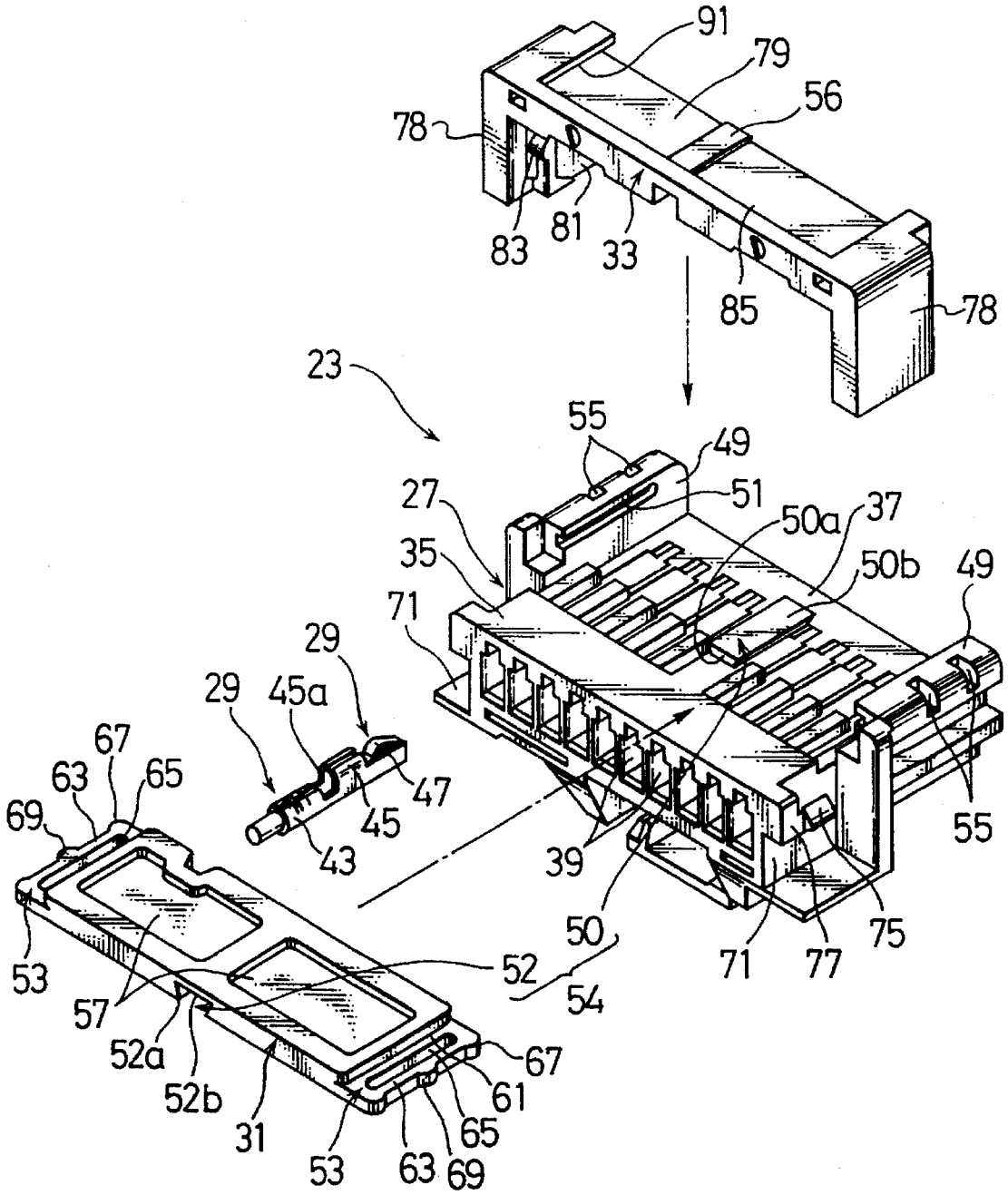
FIG. 1 is a perspective view showing a disassembled electrical connector in accordance with an embodiment of the present invention.
Figure 2:
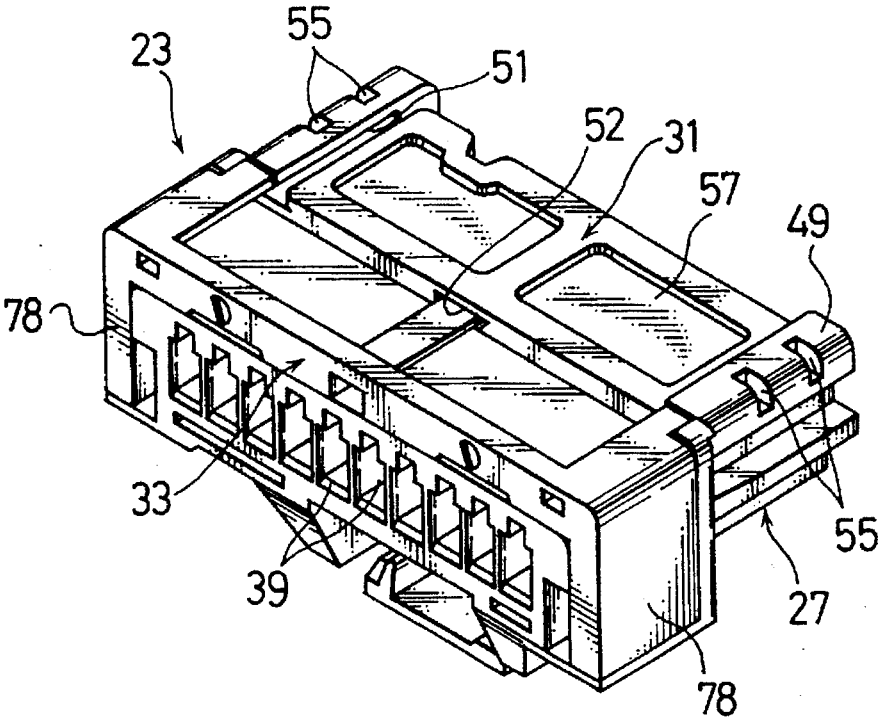
FIG. 2 is a perspective view showing the assembled connector of FIG. 1.
Figure 3:
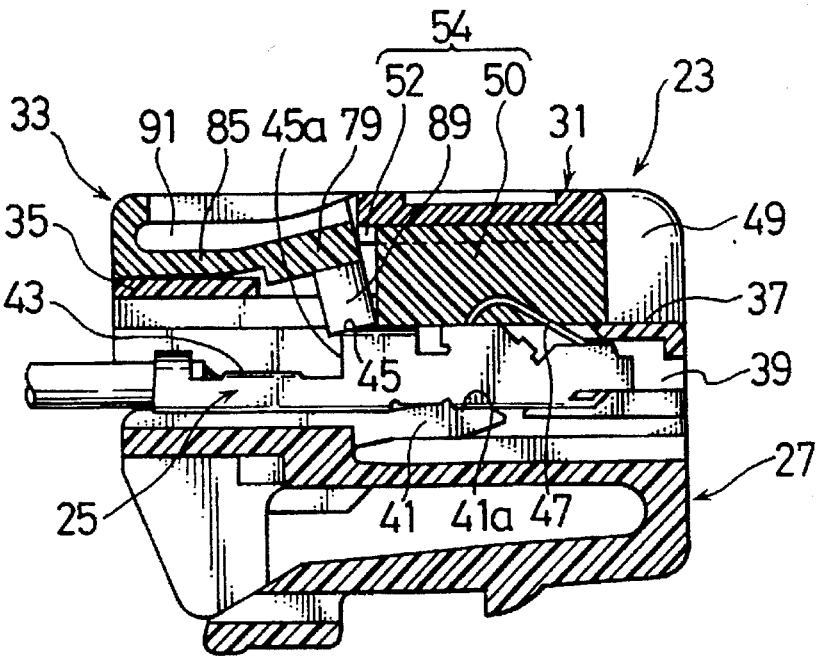
FIG. 3 is a cross-sectional view of the connector of FIG. 2, showing a terminal metal is under the semi-inserting condition in a terminal-accommodating chamber.

FIG. 1 is a perspective view showing a disassembled electrical connector 23 in accordance with an embodiment of the present invention and FIG. 2 is a perspective view of the connector 23 under the assembled condition. Further, FIG. 3 is a cross sectional view of the connector 23, showing an interior thereof.

As shown in these figures, the connector 23 consists of a housing 27 in which a plurality of terminals 29 (only one shown in the figure) are accommodated, a cover 31 for closing a contact portion 29 of each terminal metal 25 and a retainer 33 which is to be in contact with a rear end of the terminal metal 25 accommodated in the housing 27 thereby to prevent the terminal metals 25 from slipping out of the housing 27.

Figure 4:
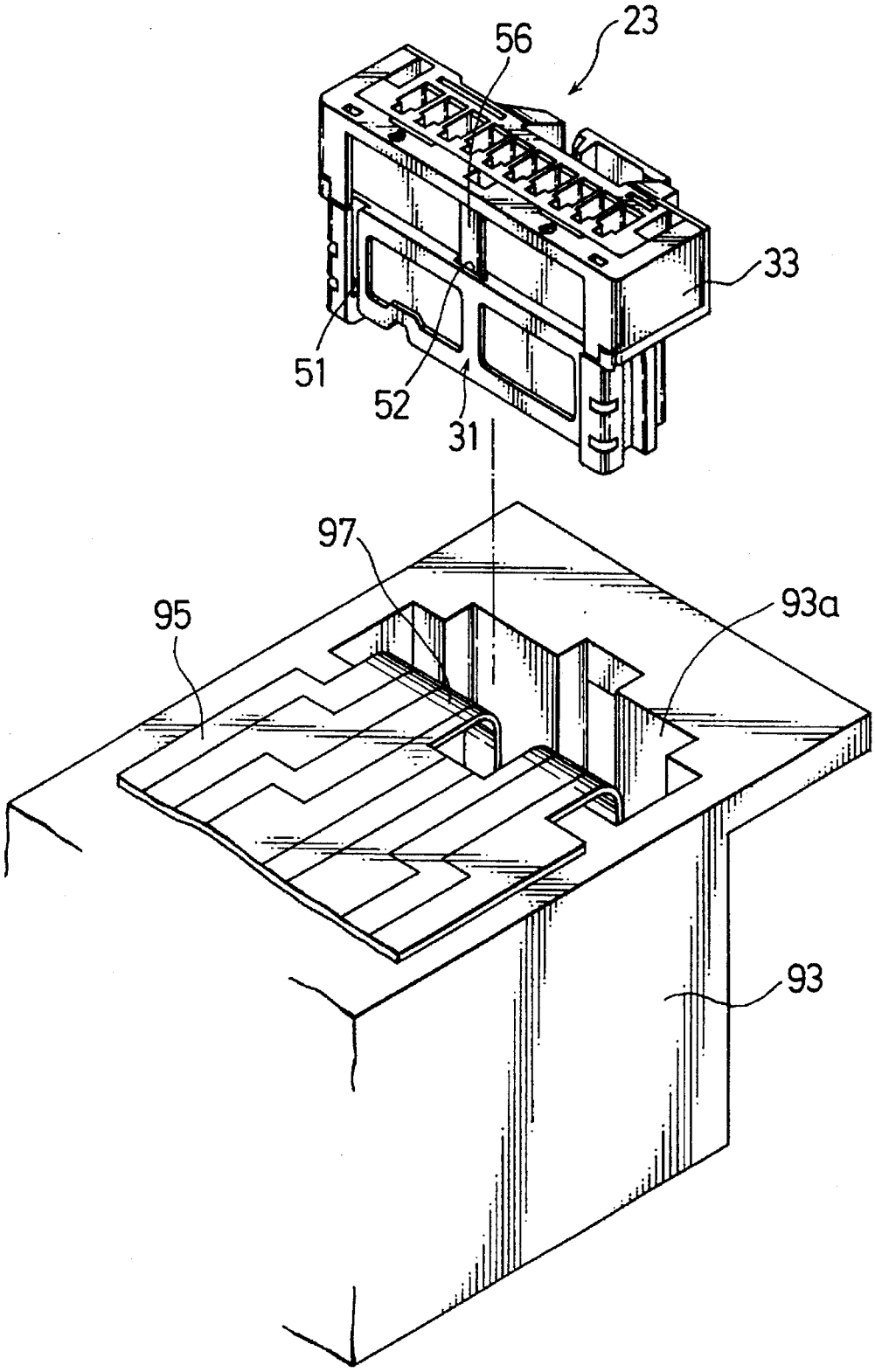
FIG. 4 is a perspective view showing the connector of the present Invention and a case into which the connector is engaged.

It is noted that, as shown in FIG. 4, these terminals 27 are to be connected with terminal sections 97 of a printed board (substrate)

The housing 27 consists of a housing body 35 and a connection part 37 which is formed integral with the body 35 and which is to be connected to the printed board 95. The housing body 35 is provided with a plurality of terminal-accommodating chambers 39. Extending up to the connection part 37, the chambers 39 are formed to have a portion opened upon the connection part 37. The terminal metals 25 are accommodated in the terminal-accommodating chambers 39, respectively.

As shown in FIG. 3, each terminal-accommodating chambers 39 is provided on an inner wall thereof with a flexible engagement arm 41 which projects therefrom. The engagement arm 41 has an engagement step 41 formed at a tip thereof. In operation, by engaging the step 41 in an engagement hole formed in the terminal metal 25, it can be prevented from slipping out of the terminal-accommodating chamber 39.

The terminal metal 25 consists of a crimp part 43 crimped and connected to a terminal of a wire W, a contact part 29 brought into contact with the terminal sections 97 of the printed board 95 and a detected part 45 arranged between the crimp part 43 and the contact part 45. These elements are formed integrally with each other. The detected part 45 is provided on a lateral side thereof facing the crimp part 43 with an engagement section 45*a* against which a convex portion 89 of the retainer 33 abuts to prevent the terminal metal 25 from slipping out. The contact part 29 is provided with an elastic contact piece 47 which is brought into contact with the terminal section 97 of the printed board 95. In assembly, this elastic contact piece 47 is positioned at the connection part 37 to expose itself to the outside thereby to be electrically connected to the terminal section 97.

The connection part 37 is provided on both sides thereof in the direction of width with walls 49, 49 for supporting the cover 31. The walls 49, 49 are respectively provided at respective inside parts thereof opposing the other wall with sliding groove 51, 51 which extend along the terminal-accommodating chambers 39. Slidably engaged in the sliding grooves 51, 51 are respective sliding portions 53, 53 which are formed on both sides of the cover 31. Further, each wall 49 has cover-lock recesses 55 formed to communicate the slide groove S1 with the outside.

Arranged between the walls 49 is an elongated rib 50 which is formed on the housing 27 to extend along the terminal-accommodating chambers 39. Having a base part 50*a* of which width dimension is smaller than that of a upper surface 50*b*, the elongated rib 50 is shaped to have a cross-section of substantial trapezoid. The rib 50 is slidably engaged in a dovetail groove 52 which is formed in a manner that an opening 52*a* thereof has a width dimension smaller than that of a bottom part 52*b*.

The cover 31 consists of a plate-shaped closing part 57 for closing the connection part 37 of the housing 27 and two sliding parts 53, 53 which are formed on both sides of the closing part 57 and engaged in the sliding groove 51 of the housing 27, respectively. The above-mentioned dovetail groove 52 is arranged on a lower surface of the closing part 57 at an intermediate position thereof in the width direction.

In the embodiment, both the dovetail groove 52 and the mating rib 50 constitute deformation-preventing means 54 for preventing a deformation of the cover 31, under condition that the rib 50 is slidably engaged in the dovetail groove 52, it is excluded that the cover 31 is raised apart from the housing body 35, so that a deflection of the cover 31 at the intermediate portion can be prevented to obstruct its deformation.

Closing the upper part of the connection part 37, the closing part 57 serves to close the opened sections of the terminal-accommodating chambers 39. Each sliding part 57 consists of a base 61 arranged on the side of the closing part 57 and a flexible plate 63 formed integral with the base 61. Formed between the base 61 and the plate 63 is a through hole 65 which allows the plate 63 to be deflected toward the base 61.

The plate 63 is provided on the outside with engagement projections 67, 69. These projections 67, 69 are engaged in the cover-lock recesses 55, 55 formed in the wall 49, respectively, thereby to lock the cover 31 on the connection part 37. With the arrangement, the connection part 37 is adapted to be engaged in its closed position. In addition, if only depressing the cover 31 against the housing body 35, it is possible to disengage the projections 67, 69 from the cover-lock grooves 55, 55 easily, so that it allows the connection part 37 to be shifted to the housing body 35, i.e., its opened position. In the housing body 35, two walls 71, 71 for mounting the retainer 33 are formed on both sides of the housing body 35, respectively. Each wall 71 has a temporary engagement projection 75 formed at the intermediate position and a formal engagement projection 77 arranged on an opened side of the terminal-accommodating chambers 39. The retainer 33 consists of two engagement sidewalls 78, 78 to be engaged with the walls 71 and a detection plate 79 for connecting the sidewalls 78, 78 with each other. On the inner surface of each sidewall 78 opposing to the other sidewall 78, there are formed a temporary engagement lock 81 to be engaged with the temporary engagement projection 75 and a formal engagement lock 83 to be engaged with the formal engagement projection 77. With such an arrangement, under condition that the temporary engagement projection 75 engages with the temporary engagement lock 81, the retainer 33 is attached in the so-called temporary engagement position. On the contrary, the retainer 33 is attached in the so-called formal engagement position under condition that the formal engagement projection 77 engages with the formal engagement lock 83. Note that, FIG. 9 shows the above-mentioned temporary and formal positions that the retainer 33 can occupy.

The detection plate 79 includes a connection base 85 and a plurality of detecting projections 89 formed corresponding to the terminal-accommodating chambers 39. Further, on an upper surface of the detection plate 79, it is provided at a center thereof with a rib 56 which is similar to the above-mentioned rib 50 of the housing 27. The rib 56 can engage with the dovetail groove 52 by moving the cover 31 to the opened position. Further, a slide groove 91 is formed between the detection plate 79 and the engagement sidewall 78.

The above-mentioned connector operates as follows.

Figure 5A:
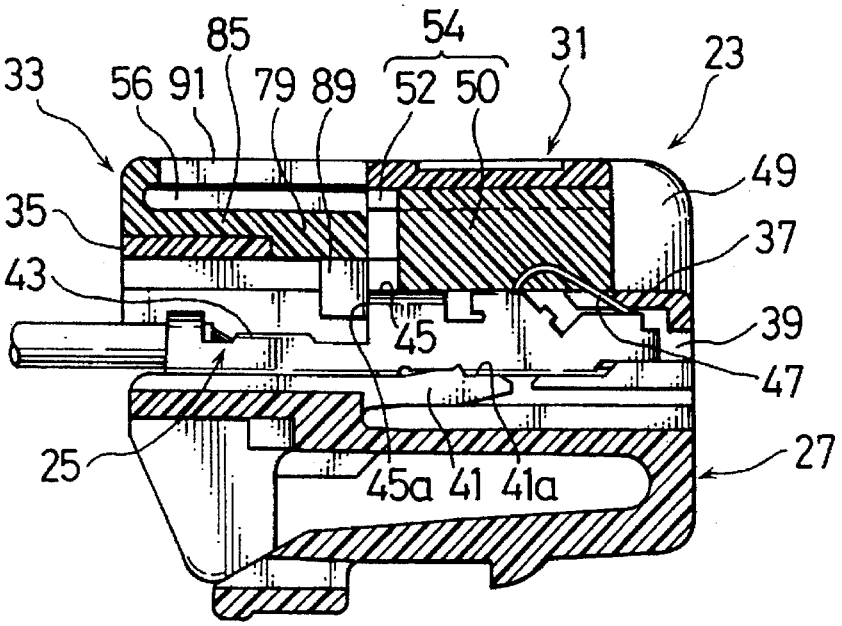
FIG. 5A is a cross-sectional view of the connector of FIG. 1, showing such a condition that the terminal metal is formally accommodated in the terminal-accommodating chamber while the retainer is attached in the formal engagement position and the cover is in the closed position.
Figure 5B:
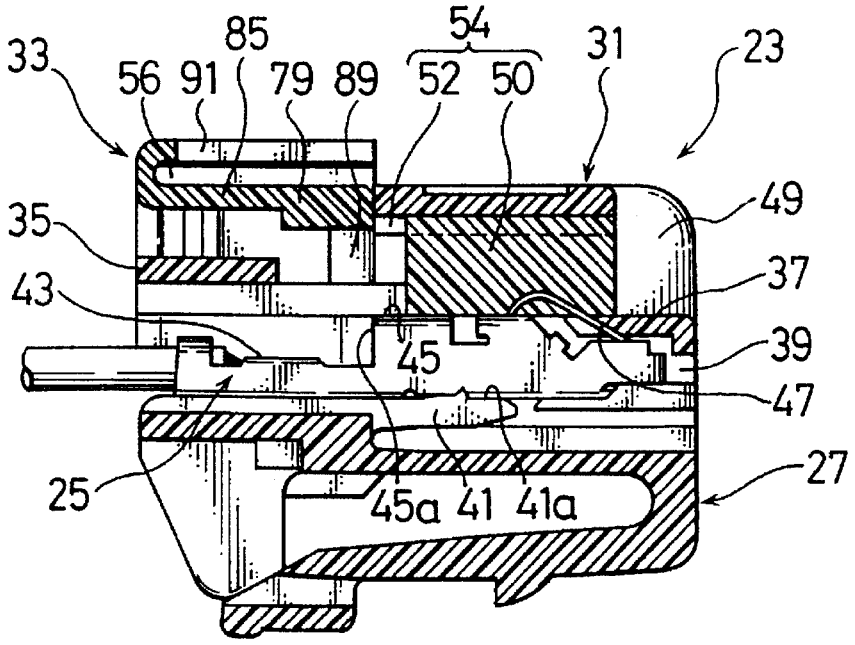
FIG. 5B is a cross-sectional view of the connector, showing such a condition that the retainer is attached in the temporary engagement position, so that the cover is prevented from moving from the closed position to the opened position.

Under condition that the retainer 33 is attached in the temporary engagement position, as shown in FIG. 5B, detection arms (not shown in the figure) of the detection plate 79 close the slide grooves 51 to prevent the cover 31 from moving to the opened position while the detecting projections 89 are withdrawn from the respective terminal-accommodating chambers 39.

On the other hand, under condition that the retainer 33 is attached in the formal engagement position, as shown in FIG. 5A, the detection plate 79 opens the slide grooves 51 to communicate with the slide grooves 91. Correspondingly, each detecting projection 89 is inserted into each terminal-accommodating chamber 39 to abut against the rear end of the detected part 45 of the terminal metal 25. Consequently, owing to the engagements by not only the engagement arms 41 but the detecting projections 89, the respective terminal metals 25 can be doubly prevented from slipping out of the terminal-accommodating chamber 39.

In this case, under the semi-inserting condition where the terminal metal 25 is not inserted up to the legal position in the terminal-accommodating chamber 39, when moving the retainer 33 to the formal engagement position, the detected part 45 of the terminal metal 25 would interfere with the detecting projection 89, so that it is impossible to move the retainer 33 from the temporary engagement position to the formal engagement position. Therefore, even if it is required to move the cover 31 from the closed position to the opened position, it is impossible to move the cover 31 to the closed position since the cover 31 interferes with the retainer 33. Consequently, it can be easily detected that the terminal metals 25 are in the semi-inserting condition in the terminal-accommodating chambers 39.

We now describe steps for connecting the so-assembled connector 23 with the terminal sections 97 of the printed board 96.

First, the cover 31 is fitted to the walls 49 of the housing 27 by engaging the sliding parts 53 into the sliding grooves 51 and simultaneously, the rib 50 of the housing 27 is fitted in the dovetail groove 52. Thus, under condition of closing the connection part 37, the cover 31 can be assembled into the housing 27. In this state, owing to configuration of the dovetail groove 52 itself, the rib 50 of the housing 27 can be prevented from slipping out of the opening, so that the raising of the cover 31 can be prevented to restrict its deformation.

Next, the sidewalls 78 of the retainer 33 is fitted to the walls 71, 71 of the housing 27. In this case, upon locking the temporary engagement projections 75 on the temporary engagement locks 81, the retainer 33 is attached in the temporary engagement position. Then, under such a condition, the terminal metals 25 are inserted into the terminal-accommodating chambers 39. Consequently, in each of the terminal-accommodating chamber 39, the engagement step 41*a* of the flexible engagement arm 41 engages with each terminal metal 25, so that the slipping-out of the terminal metal 25 from the chamber 39 can be prevented.

After inserting the terminal metals 25 into all of the terminal-accommodating chambers 39, the retainer 33 is attached to the formal engagement position by depressing the plate 79 of the retainer 33. In this state, since the detecting projections 89 engage with the engagement parts 45, the terminal metals 25 can be prevented from slipping out of the terminal-accommodating chambers 39.

At that time, providing that the terminal metals 25 is in the above-mentioned semi-inserting condition as shown in FIG. 3, it would be impossible to shift the retainer 33 to the formal engagement position since the detecting projections 89 interfere with the detected portions 45 of the terminal metals 25 in the semi-inserting condition. Under such a condition, in case of inserting the connection part 37 of the connector 23 into the engagement section 93*a* of the case 93 as shown in FIG. 4, it is impossible to slide the cover 31 from the closed position to the opened position since it interferes with the plate 79. Therefore, it is possible for an operator to find that the terminal metals 25 are in the semi-inserting condition in the terminal-accommodating chambers 39.

Hereat, it should be noted that, in case that the terminal metals 25 are in the semi-inserting condition and if pressing the retainer 33 from the temporary engagement position to the formal engagement position, the detection plate 79 may be deflected so that the retainer 33 is attached to the formal engagement position. In such a case, since the cover 31 is not deformed even if inserting the connection part 37 into the connector-engagement section 93*a* of the case 93, it can be prevented that the cover 31 is moved from the closed position to the opened position, getting over the detection plate 79. Consequently, it is possible to find that the terminal metals 25 are in the semi-inserting condition in the terminal-accommodating chambers 39 securely.

Figure 6A:
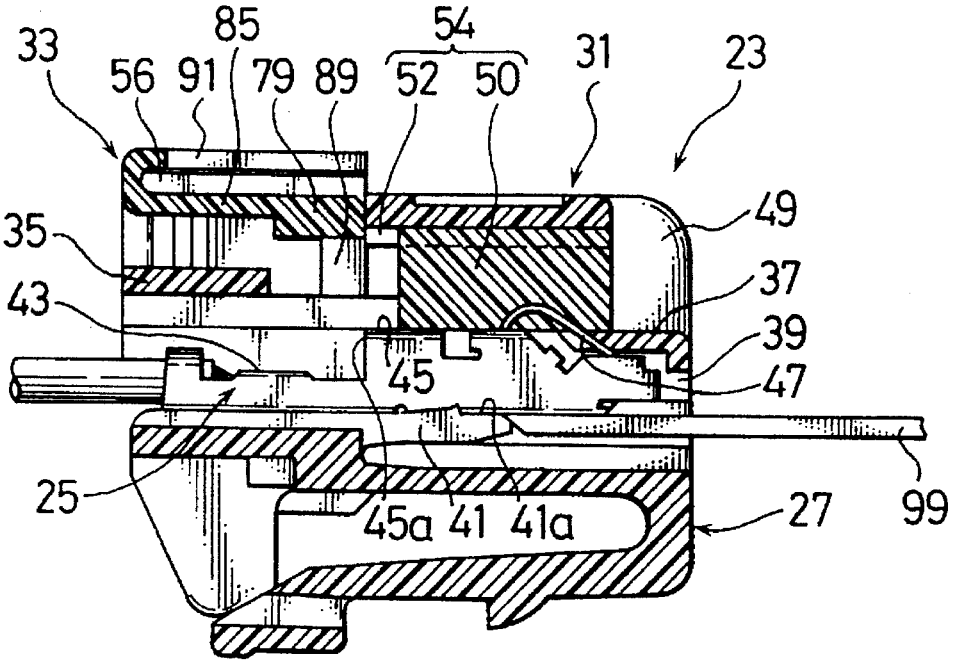
FIG. 6A is a cross-sectional view of the connector of FIG. 1, showing such a condition that the retainer is attached in the temporary engagement position and the cover is prevented from moving from the closed position to the opened position, while a tool is engaged with a tip of an engagement arm.
Figure 6B:
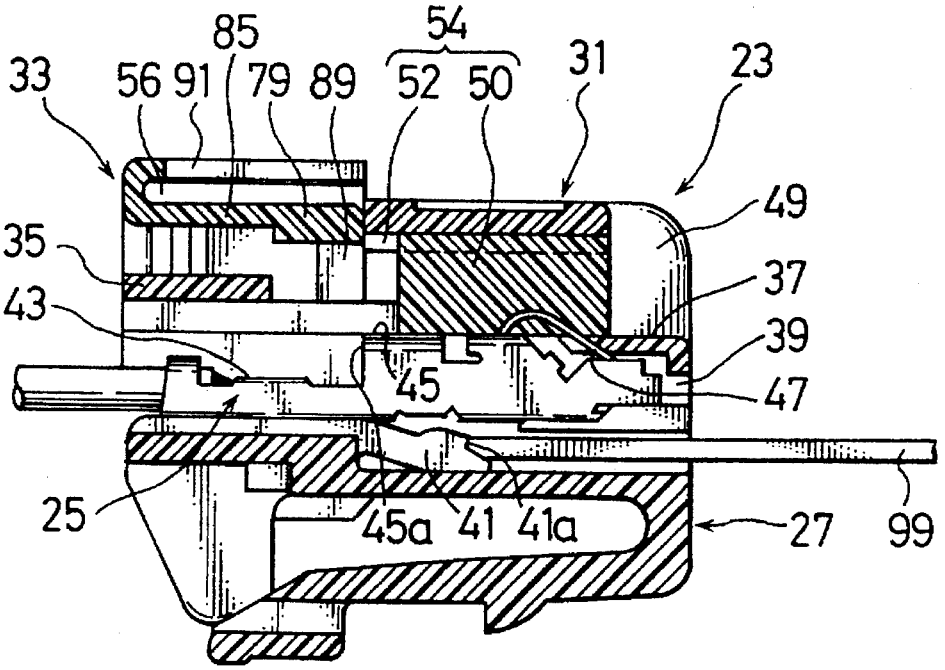
FIG. 6B is a cross-sectional view of the connector, showing a condition that the engagement arm is deflected by the tool, so that the terminal metal is disengaged from the engagement arm.

In order to pick out the terminal metal 25 from the condition of FIG. 5A where it is doubly engaged in the terminal-accommodating chamber 39 by the retainer 33, it is shifted from the formal engagement position to the temporary engagement position as shown in FIG. 5B. By this movement of the retainer 33, the detecting projection 89 can be disengaged from the engagement part 45*a*. Sequentially, as shown in FIG. 6A and FIG. 6B, a tool 99 is inserted into the terminal-accommodating chamber 39 to deflect the flexible engagement arm 41 by force, so that it is released from the engagement condition with the terminal metal 25. Then, by pulling out the terminal metal 25 from the chamber 39 on condition that the arm 41 is deflected by the tool 91, the terminal metal 25 can be picked out from the chamber 39.

Figure 7:
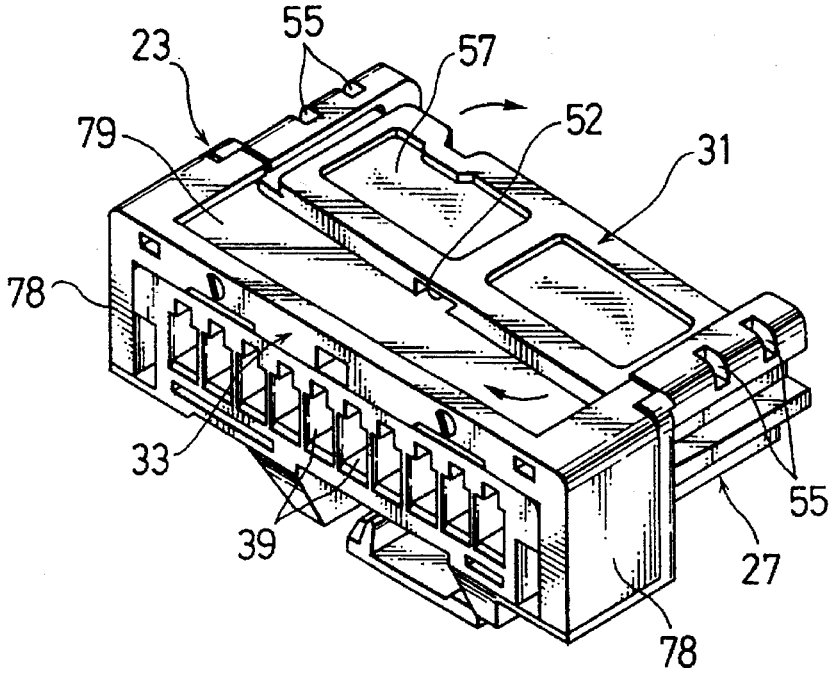
FIG. 7 is a perspective view of the connector, showing a condition that the cover is deflected so as to incline to the moving direction from the closed position to the opened position.
Figure 8:
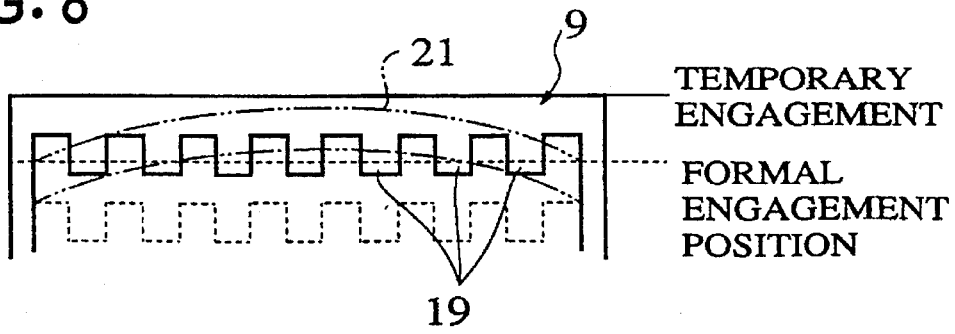
FIG. 8 is an explanatory diagram showing positions that the retainer can occupy.

As mentioned above, according to the embodiment, by providing the means 54 for preventing the deformation of the cover 31, it is possible to find a condition that the terminal metals 25 are accommodated in the terminal-accommodating chamber 39 in the semi-inserting state since the cover 31 would not deform so as to move from the closed position to the opened position even if the retainer 31 is in the formal engagement position. Furthermore, by a provision of the rib 56 on the retainer 33, it is possible to prevent it from deflecting in an oblique direction to the direction of moving from the closed position to the opened position. That is, as shown in FIG. 7, in case that no rib is provided in the plate 79, the cover 31 would deflect in directions shown with arrows thereby to move to the closed position, slanting to the moving direction. In such a case, it is impossible to insert the connection part 37 into the engagement sections 93*a* of the case 93 perfectly and to connect the elastic contact pieces with the terminal sections of the printed board securely. On the contrary, according to the invention, by providing the detection plate 79 with the rib 56 to be engaged in the dovetail groove 52, it is possible to guide and move the cover 9 to the formal opened position.

Although the groove 52 is arranged in the cover 31 while the rib 50 is arranged on the housing 27 in the above-mentioned embodiment, the groove 52 may be arranged in the housing 27 while the rib 50 is arranged on the cover 31 in the modification.

Finally, it will be understood by those skilled in the art that the forgoing description of the preferred embodiments of the disclosed connector, and that various changes and modifications may be made to the present invention without departing from the spirit and scope thereof.

What is claimed is:

1. An electrical connector for connecting a terminal metal having a contact portion to be connected with a terminal section of a board, said connector comprising:

a housing having a plurality of terminal-accommodating chamber formed therein for accommodating and engaging the terminal metal in condition of exposing the contact portion, a cover attached to said housing so as to slide between a closed position where said cover closes the contact portion and an opened position where said cover opens the contact portion when said terminal metal is connected to the terminal section of the board, said cover having a dovetail groove formed so as to extend in the sliding direction of the cover, and a retainer having a pair of sidewalls, a flexible detection plate between said sidewalls and a detection projection formed on said detection plate, said retainer being capable of engaging with the terminal metal in the terminal-accommodating chamber by its movement from its temporary engagement position to its formal engagement position thereby to prevent said terminal metal from slipping out of the terminal-accommodating chamber, said retainer also abutting on the terminal metal when it is not inserted into the terminal-accommodating chamber perfectly thereby to obstruct the movement of said cover from the closed position to the opened position, whereby it allows an operator to detect that the terminal metal is not accommodated in the terminal-accommodating chamber perfectly, wherein said housing is provided with a first rib which slidably engages with said dovetail groove, while said retainer is provided with a second rib which is formed on said flexible detection plate to slidably engage with said dovetail groove when said cover moves to the opened position.

2. An electrical connector as claimed in claim 1, wherein said housing has a connection part for exposing the contact portion of the terminal metal, said connection part being provided with said first rib, and support walls for supporting said retainer in both the temporary engagement position and the formal engagement position;

said contact portion of the terminal metal is closed by said cover closing said connecting part of said housing;

when said retainer is in the temporary engagement position, said cover is prevented from moving to the opened position; and wherein when said retainer is in the formal engagement position, said cover is slid and moved to the opened position, overlapping with said retainer, whereby said connection part can be opened.

3. An electrical connector as claimed in claim 2, wherein said cover is moved from the closed position to the opened position by a connection operation between the terminal section of the board and the terminal metal.

* * * * *